US007178179B2

(12) United States Patent
Barnes

(10) Patent No.: US 7,178,179 B2
(45) Date of Patent: Feb. 20, 2007

(54) ANTI-ENTRAPMENT DRAIN

(75) Inventor: Steven R. Barnes, Phoenix, AZ (US)

(73) Assignee: Paramount Leisure Industries, Inc., Chandler, AZ (US)

( * ) Notice: Subject to any disclaimer, the term of this patent is extended or adjusted under 35 U.S.C. 154(b) by 342 days.

(21) Appl. No.: 10/897,496

(22) Filed: Jul. 23, 2004

(65) Prior Publication Data

US 2006/0015997 A1 Jan. 26, 2006

(51) Int. Cl.
*E04H 4/00* (2006.01)

(52) U.S. Cl. ..... 4/507; 4/504; 4/292

(58) Field of Classification Search ..... 4/286, 4/289, 290, 292, 504, 507
See application file for complete search history.

(56) References Cited

U.S. PATENT DOCUMENTS

| | | | | |
|---|---|---|---|---|
| 1,454,310 | A | 5/1923 | Booraem | |
| 1,587,453 | A | 5/1926 | Hess | |
| 1,792,345 | A | 2/1931 | Williams | |
| 2,003,770 | A | 6/1935 | Goodhart | 182/31 |
| 2,695,678 | A | 11/1954 | Sisk | 182/31 |
| 2,749,999 | A | 6/1956 | Schmid | 182/31 |
| 2,777,532 | A | 1/1957 | Sisk | 182/31 |
| 3,247,968 | A | 4/1966 | Miller | 210/136 |
| 3,247,969 | A | 4/1966 | Miller | 210/169 |
| 3,378,858 | A | 4/1968 | Jacuzzi | 4/172 |
| 3,408,006 | A | 10/1968 | Stanwood | 239/66 |
| 3,486,623 | A | 12/1969 | Bosico | 210/169 |
| 3,506,489 | A | 4/1970 | Baker | 134/10 |
| 3,675,252 | A | 7/1972 | Ghiz | 4/172.17 |
| 3,703,302 | A | 11/1972 | Demler | 285/161 |
| 4,114,206 | A | 9/1978 | Franc | 4/172 |
| 4,460,462 | A | 7/1984 | Arneson | 210/163 |
| 4,487,219 | A | 12/1984 | Makela et al. | 137/362 |
| 4,503,573 | A | 3/1985 | Handzel | 4/507 |
| 4,505,814 | A | 3/1985 | Marshall | 210/166 |
| 4,561,134 | A | 12/1985 | Mathews et al. | 4/496 |
| 4,907,610 | A | 3/1990 | Meincke | 134/56 |
| 4,910,811 | A | 3/1990 | Izzi, Sr. | 4/292 |
| D319,295 | S | 8/1991 | Ohaus | D23/261 |
| 5,135,579 | A | 8/1992 | Goettl | 134/10 |
| 5,265,631 | A | 11/1993 | Goettl | 134/111 |
| 5,268,096 | A | 12/1993 | Robol | 210/164 |

(Continued)

OTHER PUBLICATIONS

CSI, Leaf Trapper Main Drain System Installation Bulletin, no publication year listed.

*Primary Examiner*—Huyen Le
(74) *Attorney, Agent, or Firm*—Cahill, von Hellens & Glazer P.L.C.

(57) ABSTRACT

A drain for swimming pools, spas, whirlpool baths, etc., includes a plurality of first orifices in communication with corresponding serpentine passageways to minimize hair or a body part from covering and entering the first orifices to a degree sufficient to entrap a bather. A plurality of second orifices independent of the first orifices and in fluid communication with one another through a peripheral passageway provide a flow of water from the peripheral passageway into the serpentine passageways to create an alternate water inflow path and reduce the pressure differential and possible entrapment that might occur should a body part or hair come in contact with or enter the first orifices. Moreover, a plurality of ridges are attendant the first orifices to reduce the likelihood of direct contact with the first orifices by a body part or hair.

42 Claims, 5 Drawing Sheets

U.S. PATENT DOCUMENTS

| | | | | |
|---|---|---|---|---|
| 5,341,523 | A | 8/1994 | Barnes | 4/507 |
| 5,408,706 | A | 4/1995 | Barnes | 4/507 |
| 5,799,339 | A | 9/1998 | Perry et al. | 4/286 |
| 5,822,807 | A | 10/1998 | Gallagher et al. | 4/507 |
| 5,878,773 | A | 3/1999 | Robol | 137/112 |
| 5,947,700 | A | 9/1999 | McKain et al. | 417/306 |
| 5,978,981 | A | 11/1999 | Nelson | 4/541.1 |
| 5,991,939 | A | 11/1999 | Mulvey | 4/504 |
| 6,088,842 | A | 7/2000 | Barnett | 4/286 |
| 6,098,654 | A | 8/2000 | Cohen et al. | 137/467 |
| 6,341,387 | B1 | 1/2002 | Zars | 4/504 |
| 6,397,408 | B1 * | 6/2002 | Veloskey et al. | 4/504 |
| 6,419,840 | B1 | 7/2002 | Meincke | 210/767 |
| 6,438,766 | B1 | 8/2002 | Arnau | 4/490 |
| 6,442,774 | B2 * | 9/2002 | Wilson et al. | 4/504 |

* cited by examiner

ANTI-ENTRAPMENT DRAIN

BACKGROUND OF THE INVENTION

1. Field of the Invention

The present invention relates to drains for swimming pools, spas and whirlpool baths and, more particularly, to a drain for reducing the likelihood of entrapment of a person's hair and body parts.

2. Description of the Related Art

Typically, a suction outlet or drain used in a pool or spa is located at the bottom or in a wall of such pool, spa or bath. The drain provides an outflow of water into a suction line connected to a suction pump. A debris trap or the like may be disposed between the suction line and the pump to collect large sized debris. Usually, the outflow from the pump passes through a filter and is ultimately returned to the pool, spa or bath.

The suction attendant the drain may be significant, which poses a danger to a user of or a bather in the pool, spa or bath. Should the drain be covered by a body part, the force of the suction acting on such body part may be sufficient to prevent the person from extricating himself/herself and drowning may occur or significant injury may result. Often, the hair of a bather may be drawn into the drain and become tangled about elements of the drain or wrapped about itself to the extent that extrication may be impossible. Again, the consequences may include drowning. Because of these hazards to users of a pool, spa or bath, various efforts have been undertaken to preclude such entrapment.

In 1923, Booraem disclosed in U.S. Pat. No. 1,454,310 a rudimentary grating covering a drain for the purpose of protecting a bather from the hazards associated with limb entrapment. The grate also served the function of screening debris to keep it out of the suction line and other downstream elements.

As spas and whirlpool bathtubs became more widely used, the bathers were usually in much closer proximity to an active drain for longer periods of time. This resulted in hair entrapment injuries as well as drowning. The increase of injuries of this type and related drownings dictated the evolvement of drains with more effective features to prevent hair entrapment. A resulting improvement of the drain was that of using a cover with small orifices to reduce the likelihood of hair passage therethrough. However, when a large volume of hair was proximate the apertures, the resulting differential pressure was often sufficient to draw hairs through the small orifices. After the hair passed through the orifices, it often wrapped about itself and effectively prevented withdrawal of the hair. An improvement to the use of such small orifices is disclosed in a 1998 patent to Perry, Et al., U.S. Pat. No. 5,799,399 which taught the use of internal guide vanes to reduce turbulent flow of the water and thereby reduce tangling of hair passing through the orifices. Guide vanes reduced the likelihood of hair entanglement, but the problem was still present, especially when the orifices were essentially covered by hair.

Another approach to prevent hair entanglement is disclosed by Nelson in U.S. Pat. No. 5,978,981 wherein a plurality of elongated flow channels are provided which are of sufficient length that hair cannot reach the end of the channels where it might tangle. Since some bathers have very long hair, the channels had to be of extended length to prevent entanglement of such hair. This necessitated a large drain cover which was difficult to manufacture. It also required significant space to accommodate the channels which space was often impractical or impossible in many typical locations.

U.S. Pat. No. 6,088,842, issued to Barnett discloses another approach by providing a plurality of protrusions positioned to form a grating arrangement with a single opening. The protrusions are shaped to facilitate the removal of tangled hair. This apparatus may work well for limited volumes of hair exposed to limited flow rates. However, most modern suction pumps have significant flow capabilities well above the level required to create turbulent flow behind the protrusions. Such turbulence can and will tangle hair making it difficult or impossible to pull the hair back through the openings.

To address the hazard of entrapment a body part due to the pressure differential across a drain cover when it is blocked by the body part, certain standards have been promulgated by the National Spa and Pool Institute. In particular, such standards prohibit the use of a single point suction on small drain covers that can be completely blocked by a bather. The most widespread solution and compliance with the standards involves the use of two drains in fluid communication with one another through a common suction line. When such arrangement is used, complete blockage of one drain will not result in significant pressure differential across the blocked drain as the suction force is relieved by flow through the second drain. Thus, removal of the body part from the affected drain was usually possible.

While single-point suction is prohibited by most construction standards and codes, such is not always the case. Even when it is, installers are frequently unaware of the requirement or simply feel that it is not necessary based on their personal experience. It is therefore of import to provide a suction outlet or drain which self-limits the water flow and localized velocities to a level below that required to entangle or entrap hair. Additionally, it would be beneficial to minimize the amount of differential pressure that may come in contact with a bather by dispersing the inlet orifices over a large area to reduce the likelihood of complete blockage.

It is therefore a primary object of the present invention to provide a drain for a pool, a spa or a whirlpool bath that reduces the likelihood of entry of hair through the inlet orifices.

Another object of the present invention is to provide a drain for a pool, spa or bath which includes secondary inlet orifices to prevent a pressure differential across the drain in the event of partial or complete blockage of the primary inlet orifices.

Still another object of the present invention is to provide inlet orifices having mechanical features for reducing the likelihood of passage of hair therethrough.

Yet another object of the present invention is to provide a drain for a pool, spa or bath that reduces the likelihood of entanglement of any hair that may inadvertently enter through the inlet orifices.

A further object of the present invention is to provide a drain for a pool, spa or bath that has a limited water flow rate through each of a plurality of inlet orifices relative to the water flow rate of the suction line connected to the drain.

A yet further object of the present invention is to provide passageways extending from inlet orifices to segregate any hair entering therein and prevent entanglement.

A still further object of the present invention is to provide a method for reducing the likelihood of entrapment of hair in a drain for a pool, spa or whirlpool bath.

These and other objects of the present invention to those skilled in the art as the description thereof proceeds.

BRIEF SUMMARY OF THE INVENTION

An anti-hair entrapment drain includes a cover having a central impervious surface generally coincident with an underlying suction line. A plurality of laterally extending first orifices extend from the impervious surface to provide primary water inlets. The water is channeled through passageways defined by adjacent walls extending radially inwardly to an aperture in an underlying plate, which aperture is in fluid communication with the suction line. A second set of orifices, generally radially coincident with the first set of orifices, are in fluid communication with one another through a peripheral passageway. The peripheral passageway is also in communication with the passageways extending from the first set of orifices. The water inflowing through the passageways enters the suction line through a bulkhead fitting. The drain may be attached to the shell of a fiberglass pool or spa with a collar threadedly engaging a threaded section of the bulkhead fitting extending through an aperture in the shell. The drain may be attached to the liner of a pool or spa by capturing the liner between the plate and the bulkhead fitting. The cover and plate, absent the bulkhead fitting of the drain may be detachably attached to a ring mounted in the wall or the bottom of a swimming pool or spa and encircling or adjacent an existing suction line.

BRIEF DESCRIPTION OF THE DRAWINGS

The present invention will be described with greater specificity and clarity with reference to the following drawings in which.

DESCRIPTION OF PREFERRED EMBODIMENT

Figure 1:
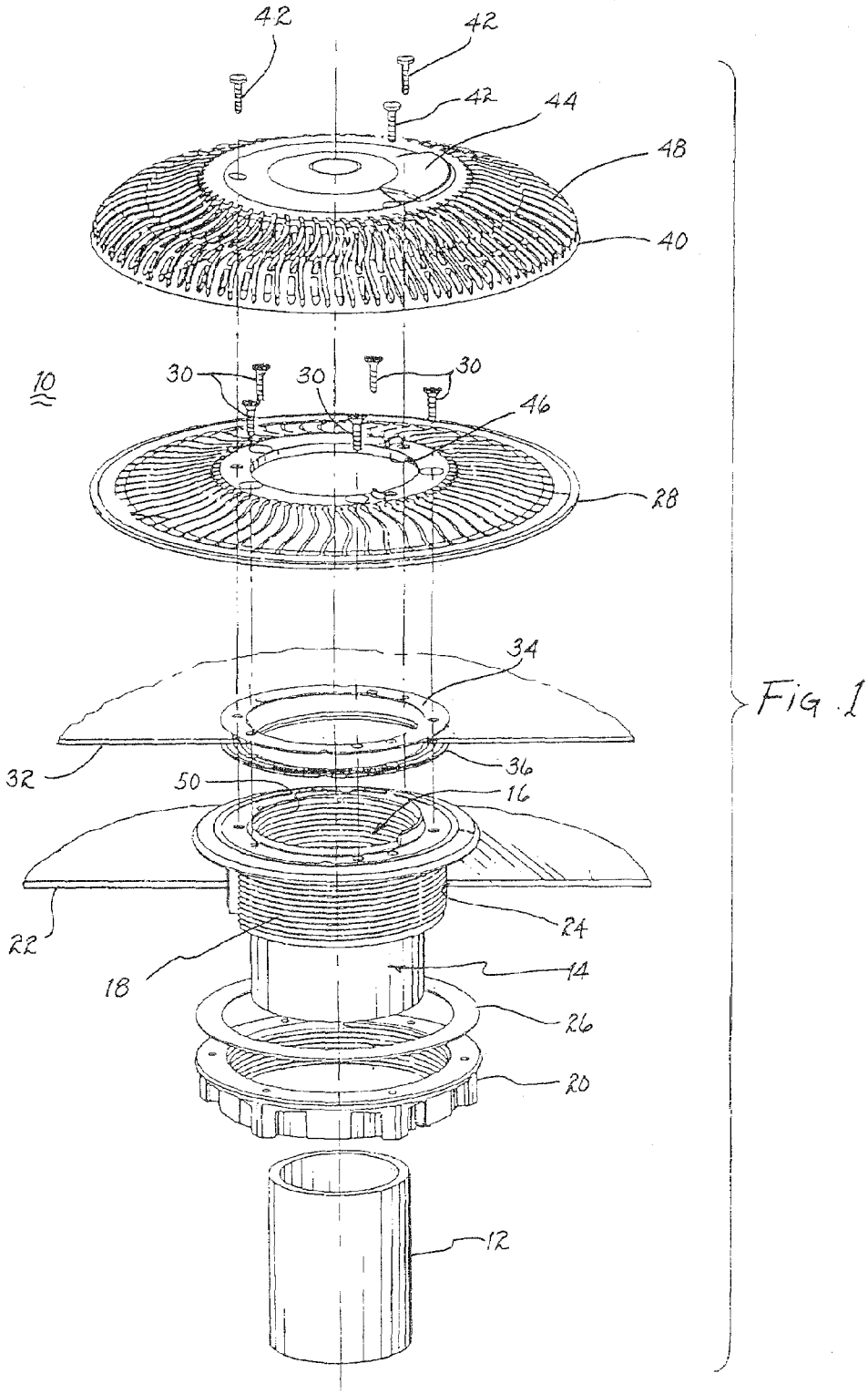
FIG. 1 is an exploded view of the major components of the anti-entrapment drain.
Figure 2:
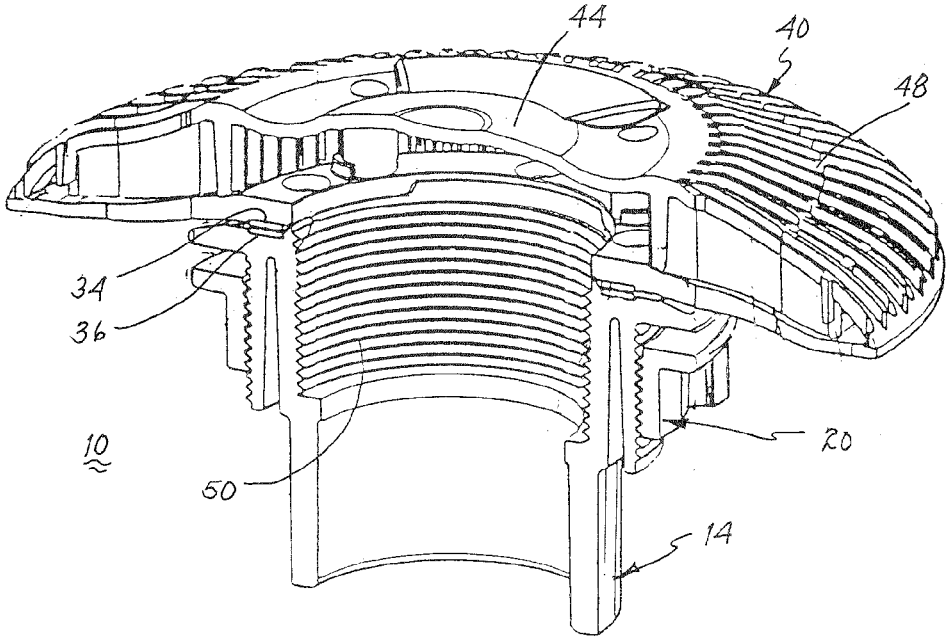
FIG. 2 is a partially cutaway perspective view of the drain.
Figure 2A:
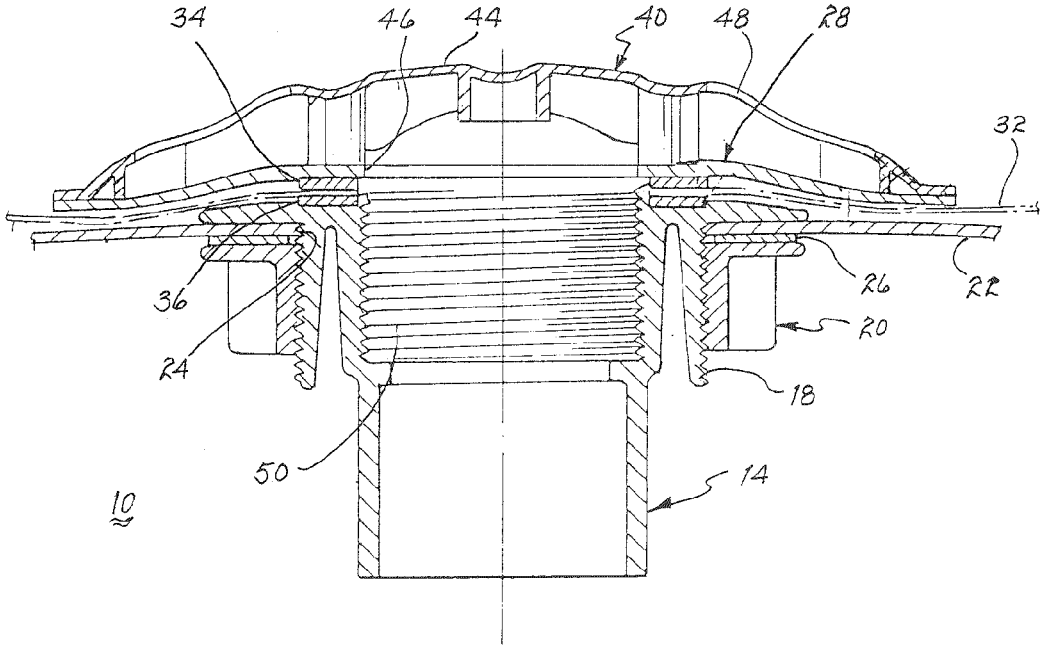
FIG. 2A is a cross-sectional view of the drain.

Referring to FIG. 1, there is shown an exploded view of a drain 10 for use in a swimming pool, spa or whirlpool bath. The drain is connected to a suction line, representatively identified by numeral 12, which conveys water to a suction pump. The water flowing to the suction pump may pass through a debris trap to collect large sized debris. The water outflow from the suction pump may pass through a filter and into a return line for return to the pool, spa or whirlpool bath.

Referring jointly to FIGS. 1, 2, 2A, 3 and 4, details of the drain will be described. Suction line 12 is attached to a bulkhead fitting 14, which bulkhead fitting includes a central outlet 16 in fluid communication with the suction line. The bulkhead fitting includes external threads 18 for threaded engagement with a collar 20. If the drain is to be used in conjunction with a fiberglass pool, spa or whirlpool bath having a shell 22, the lower body of the bulkhead fitting is in penetrable engagement with an aperture 24 in the shell. The bulkhead fitting is secured with the shell by collar 20 and a gasket 26 is disposed above the shell and below the annular flange of the bulkhead fitting to ensure a water tight fit. A plate 28 is secured to bulkhead fitting 14 by a plurality of attachment means, such as screws 30.

If drain 10 is to be used in conjunction with the liner of a pool, spa or bath such as liner 32, shown in dashed lines, the liner would be placed on top of bulkhead fitting 14 and secured by attachment means, such as screws 30, penetrably engaging plate 28, liner 32 and in threaded engagement with the bulkhead fitting. A pair of gaskets 35, 36 may be placed on either side of the liner to ensure a water tight fit. Obviously, the material of the liner corresponding with the size of central outlet 16, would be cutaway after installation.

Cover 40 is secured to plate 28 by attachment means, such as screws 42. The cover includes a central impervious surface 44 generally coincident with opening 46 in plate 28 and central outlet 16 in bulkhead fitting 14. A plurality of slots or first orifices 48 extend radially from surface 44 and serve as inlets to the water flowing into drain 10.

Internal threads 50 in bulkhead fitting 14 are used for the purpose of threadedly receiving a plug to test the integrity of the suction line during installation and/or subsequent replacement or repair. These threads have no other purpose with respect to operation of drain 10.

Referring jointly to FIGS. 3, 4, 4A, 5, 6 and 7, details of plate 28 and cover 40 and their operative interrelationships will be described in detail. Cover 40 has a central impervious surface 44 generally centered in the cover. This surface is essentially vertically coincident with central outlet 16 disposed in bulkhead fitting 14. Thereby, direct flow of water through the cover into the central outlet is prevented. A plurality of slots, primarily referred to as first inlet orifices 48, extend essentially radially from surface 44 around the cover. As shown in cross section in FIG. 4A, first inlet orifices 48 are defined by pairs of walls 60 the upper edge of which includes a cap 62. The space between adjacent caps defines the width of first inlet orifices 48. It has been learned that by maintaining upper edges 64, 66 of each of caps 62 sharp edged and the lower edges rounded, a strand of hair is less likely to pass thereacross and into the first orifice. A ridge 68 extends upwardly from each of caps 62. The purpose of this ridge is to reduce the likelihood of a body part or hair coming in direct contact with the first orifice. Without such contact, it is unlikely that water flow through the first orifice will be blocked by a body part and it is further unlikely that hair will be drawn through the first orifice. By having upper side 69 of each ridge rounded, as illustrated, a body part or hair(s) is more likely to slide thereacross and not be drawn into an adjacent first orifice.

Figure 3:
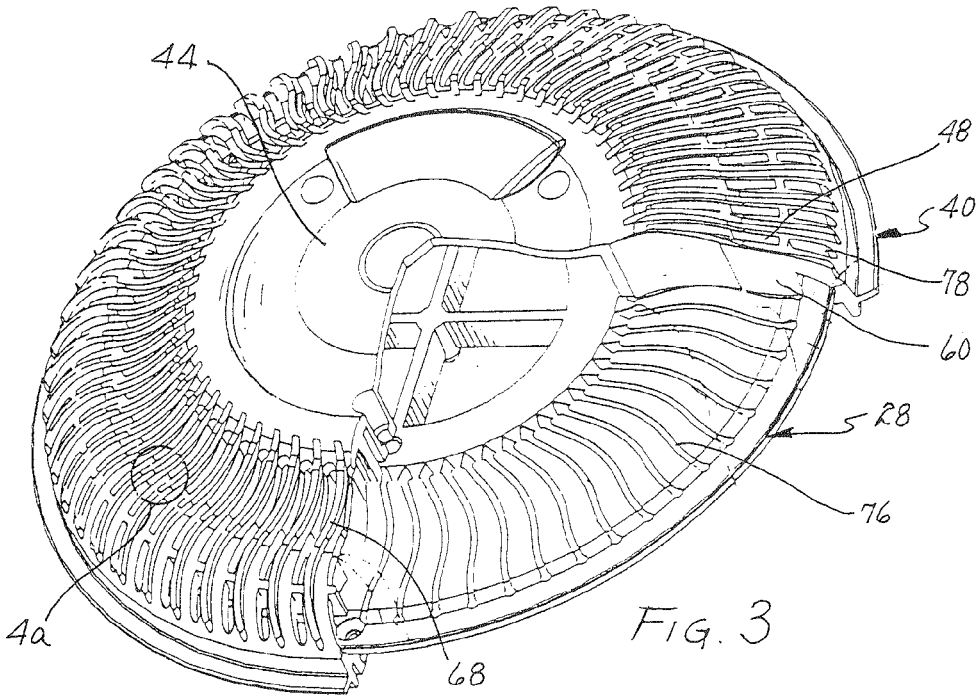
FIG. 3 illustrates a partly cutaway view of a cover mounted upon a plate.

As particularly illustrated in FIG. 3, the depth (vertical dimension) of walls 60 increases radially inwardly. Commensurate therewith, the spacing between the walls decreases in the radial inward direction. By appropriate dimensioning, the cross-sectional area between adjacent walls increases radially inwardly and the flow rate therebetween is reduced to further reduce the likelihood of hair being drawn radially inwardly between the walls.

Figure 4:
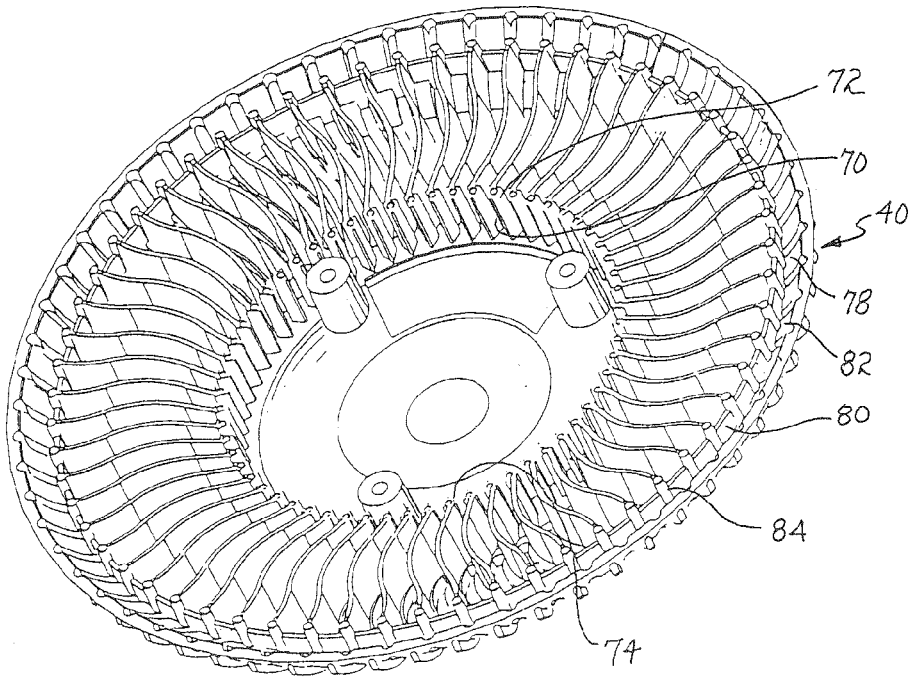
FIG. 4 illustrates the underside of the cover.
Figure 7:
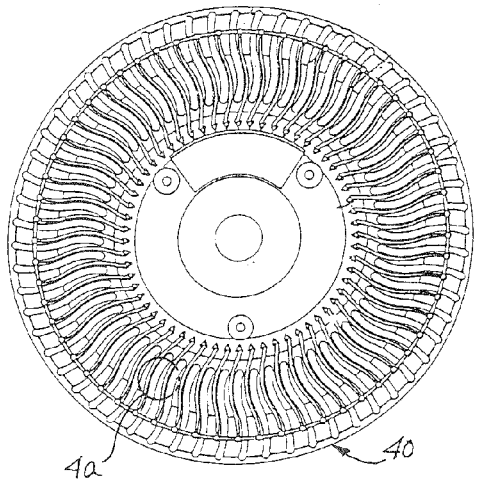
FIG. 7 illustrates a bottom view of the cover.

As particularly shown in FIG. 4, outlet orifice 70, as defined between adjacent walls 60, has a greater vertical dimension than width. To further discourage passage of hair through the outlet orifice, the inner edge of each wall is terminated by an abutment 72. This abutment is generally arrow shaped in cross section, as illustrated in FIGS. 4 and 7. Such arrow shape presents a vertical side 74 extending from opposed walls of the outlet orifice and each side is terminated by a sharp edge to restrain sliding movement of hair therepast.

Figure 5:
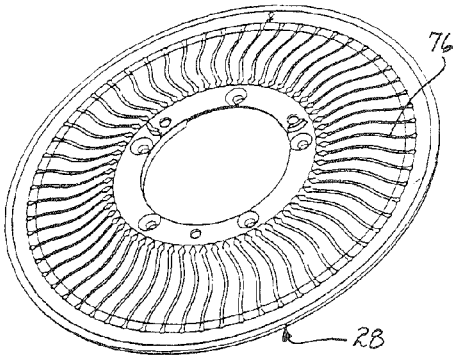
FIG. 5 illustrates the plate useable in conjunction with a fiberglass wall or bottom or vinyl-lined wall or bottom of a pool, spa or whirlpool bath.

Plate 28 includes a plurality of depressions 76, as particularly shown in FIGS. 3 and 5. Each of depressions 76 corresponds with the lower edge of one of walls 60. Thereby, the lower edge of each wall is nested and sections of plate 28 define the bottom surface of the passageways through cover 40 from first inlet orifice 48 to the outlet orifice 70.

As particularly illustrated in FIGS. 2, 2A, 3 and 4, cover 40 includes second orifices 78. A peripheral wall 80 segregates first orifices 48 from the second orifices. Such wall, in combination with the part of cover 40 radially external to the wall in combination with plate 28 defines an annular or peripheral passageway 82 placing all second orifices in fluid communication with one another. As particularly noted in FIG. 4, studs 84 are formed as part of wall 80 but extend downwardly therefrom. The space between adjacent studs, the lower edges of wall 80 and plate 22 defines an aperture to provide fluid communication between peripheral passageway 82 and the passageways between adjacent walls 60. It may be noted that the location of second orifices 78 is in a downwardly sloping section of cover 40.

The primary purpose for embodying the second orifices is that of providing an alternate water flow path to central outlet 16 in the event most of first orifices 48 become covered by a body part or a mass of hair. Thereby, the pressure differential attendant the first orifices is maintained relatively benign to permit a bather to extricate himself/herself from the drain.

As particularly shown in FIGS. 3, 5, 6 and 7, walls 60 and depressions 76 are serpentine in configuration. It has been learned that the resulting convoluted configuration of the passageways formed thereby further reduces the likelihood of hair being drawn into and through the passageways. This result is due in part to the fact that most wet hair is relatively straight and therefore will tend to bridge rather than flow into each of the first orifices. As noted in FIG. 3, ridges 68 are similarly serpentine in configuration.

Figure 8:
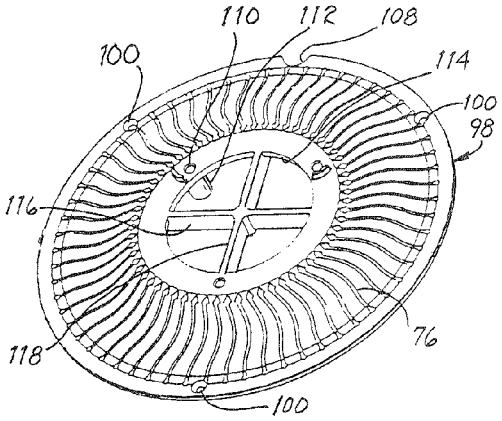
FIG. 8 illustrates a plate usable in conjunction with a pool, spa or bath of cementitious material.
Figure 9:
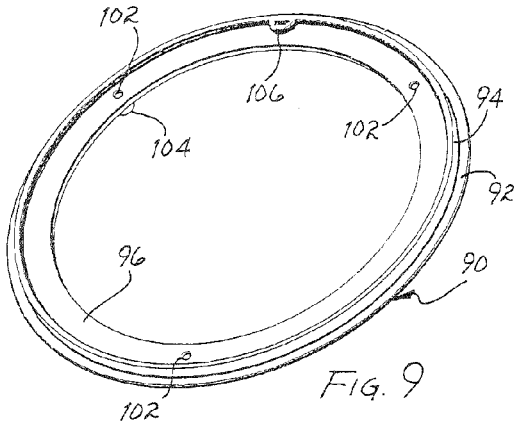
FIG. 9 illustrates a mounting ring used in conjunction with the plate shown in FIG. 8.

As discussed above with particular reference to FIGS. 1 and 2A, capability for mounting drain 10 in a fiberglass pool, spa or whirlpool bath has been described. Similarly, the capability for mounting drain 10 in a liner pool or spa has been described. Referring jointly to FIGS. 8 and 9, there is shown the structure necessary to mount drain 10 in new construction of a pool, spa or whirlpool bath formed of cementitious material. Ring 90 includes an annular band 92 and a circular wall 94 extending upwardly therefrom. Prior to setting of the cementitious material, ring 90 would be pressed thereinto and the cementitious material would be troweled upon band 92 and adjacent the outer surface of wall 94. Upon setting of the cementitious material, the ring would be firmly locked in place. Under certain circumstances, it may be preferable to similarly lock the ring in the plaster coating usually forming the finished surface of a pool, spa or whirlpool bath. In either event, the ring would be captured and permanently retained in place.

The ring includes an interior annular band 96 for supporting plate 98 (similar to plate 28). The plate includes a plurality of apertures 100 for penetrably receiving attachment means, such as screws, bolts, or the like, and threadedly engaging holes 102 and underlying bosses 104 in ring 90. A key 106 in the ring corresponds with a keyway 108 in the plate to maintain orientation of the plate with respect to the ring. The plate further includes holes 110 and corresponding bosses 112 for penetrably and threadedly receiving attachment means, such as screws 42 (shown in FIG. 1) for securing cover 40 to plate 98. Outlet 114 is coincident with a stub of a suction line lodged within and extending through the cementitious material forming the pool, spa or whirlpool bath and is ultimately connected to a suction pump as described above. A pair of cross members 116, 118 may extend across outlet 114 as shown. As illustrated, plate 98 includes depressions 76 and this plate serves the same operative functions as plate 26 described above.

Figure 10:
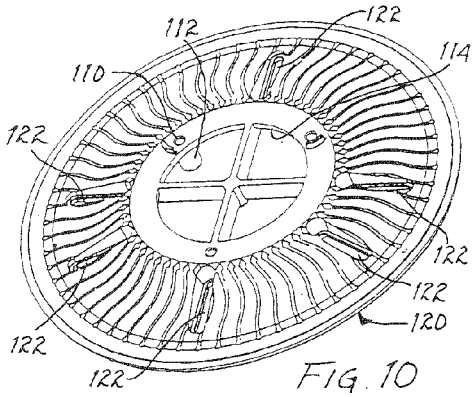
FIG. 10 illustrates a plate useable to retrofit the present drain in an existing pool, spa or bath.
Figure 6:
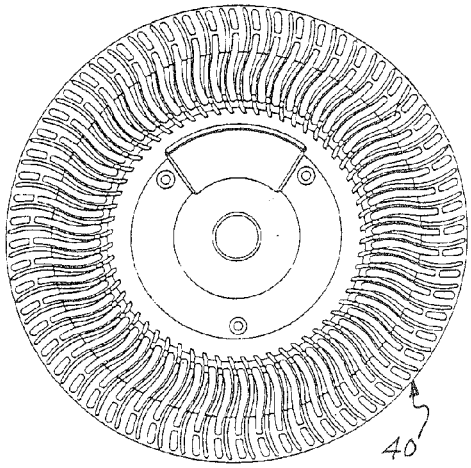
FIG. 6 illustrates a top view of the cover.

In existing pools having a drain not embodying the anti-entrapment features of the present invention, it may be advantageous and preferable to install drain 10 described herein. Referring to FIG. 10, there is illustrated a plate 120 which is useful for this purpose. This plate is similar to plates 28 and 98, shown in FIGS. 5 and 8, with certain modifications. Keyway 108 is not necessary and therefore has been omitted. It is presumed that plate 120 will be placed adjacent the inlet to an existing suction line. Accordingly, outlet 114 would be placed coincident with such inlet. A plurality of elongated apertures 122 may disposed at various locations in plate 120. The purpose of these apertures is that of permitting bolts, screws or other attachment means to penetrably engage these apertures and into engagement with the underlying plaster and/or cementitious material to retain plate 120 in place. After installation, cover 40 (see FIG. 1) is attached by attachment means such as screws 42 extending through the cover and into threaded engagement with holes 110 and underlying bosses 112.

Figure 11:
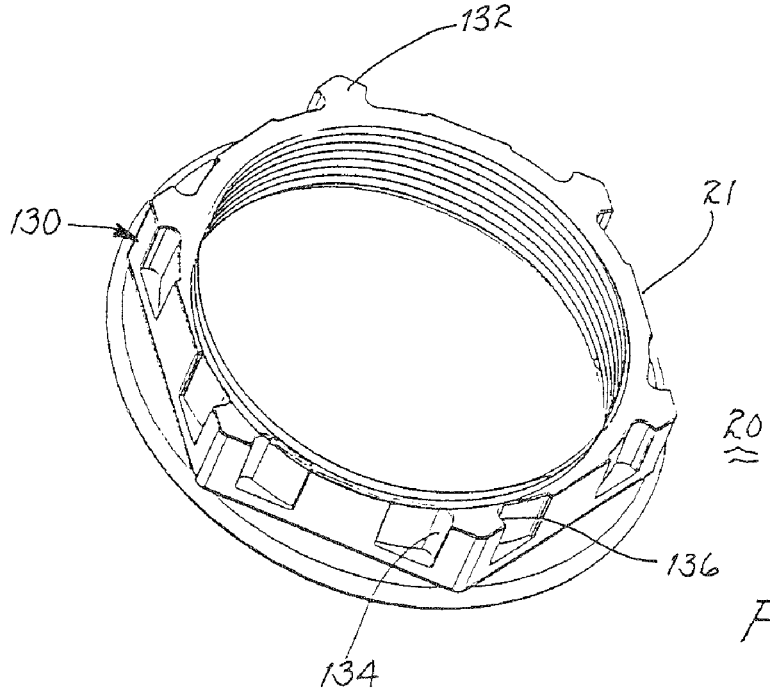
FIG. 11 illustrates a collar for threaded engagement with the bulkhead fitting.
Figure 4A:
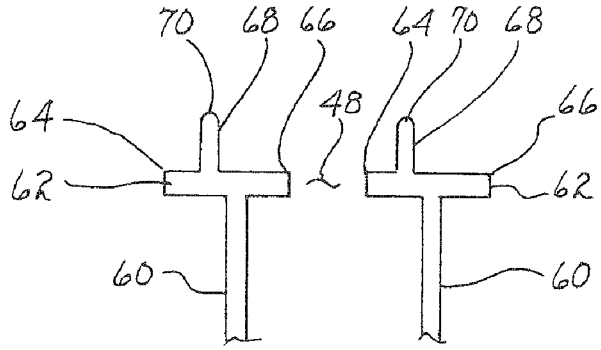
FIG. 4A is a detailed view taken within circle 4A shown in FIG. 3.

Referring to FIG. 11, there is illustrated in detail collar 20. Although the collar includes a hexagonal section 130, most workmen do not carry a wrench of sufficient size to engage the hexagonal section. For such instances, nubbins are formed at the intersection of each face of the hexagonal section. Each of these nubbins includes notches 134, 136 disposed on either side. These notches permit a workman to tighten the collar by placing an implement, such as a screwdriver, therein and striking it to impart a rotational force to the collar. Thus, the collar can be more than hand tightened very easily using conventional tools and a bit of manual force.

I claim:

1. A drain apparatus useable in a swimming pool, a spa or a whirlpool bath for preventing entanglement of hair and body parts, said drain apparatus comprising in combination:

a) a bulkhead fitting for penetrable engagement with a surface of the pool, spa or bath, said bulkhead fitting including a central outlet adapted for fluid communication with a suction pump for drawing water from the pool, spa or bath through said drain apparatus;

b) a plate secured to said bulkhead fitting for lodgement adjacent a surface of the pool, spa or bath;

c) a cover secured to said plate, said cover including:

1) a central impervious member;

2) a plurality of first orifices extending radially from said member;

3) a plurality of walls extending downwardly to said plate for defining a plurality of generally radially oriented passageways coincident with said first orifices;

4) an outlet orifice generally coincident with the radially interior end of each of said passageways and in fluid communication with said central outlet;

5) a plurality of second orifices located radially outwardly of said first orifices;

6) a peripheral wall segregating said first orifices from said second orifices and defining a common peripheral passageway in fluid communication with each of said second orifices, said peripheral wall being spaced from said plate to provide fluid communication between said peripheral passageway and said radially oriented passageways; and d) attachment means for securing said bulkhead fitting with a surface of the pool, spa or bath.

2. The drain apparatus as set forth in claim 1, wherein each of said first orifices is serpentine in configuration.

3. The drain apparatus as set forth in claim 1, including a ridge extending upwardly between adjacent ones of said first orifices.

4. The drain apparatus as set forth in claim 3, wherein the upper edges of each of said plurality of first orifices are sharp edged.

5. The drain apparatus as set forth in claim 4, wherein the lower edges of each of said plurality of first orifices are rounded.

6. The drain apparatus as set forth in claim 3, including a ridge extending upwardly between adjacent one of said first orifices.

7. The drain apparatus as set forth in claim 1, including converging walls defining in part each first orifice of said plurality of first orifices.

8. The drain apparatus as set forth in claim 7, including a ridge extending upwardly from each wall of said converging walls.

9. The drain apparatus as set forth in claim 8, wherein each of said ridges includes a rounded upper edge.

10. The drain apparatus as set forth in claim 8, wherein each of said converging walls includes a pair of sharp edged upper edges.

11. The drain apparatus as set forth in claim 10, wherein each of said ridges is disposed intermediate said sharp edged edges of the corresponding one of said converging walls.

12. The drain apparatus as set forth in claim 10, wherein each wall of said converging walls includes a rounded bottom edge.

13. The drain apparatus as set forth in claim 1, wherein each wall of said plurality of walls includes a bottom edge and wherein said plates includes a plurality of depressions each of said depressions being adapted for receiving and nesting said bottom edge of one of said plurality of walls.

14. The drain apparatus as set forth in claim 1, wherein the radially interior end of each wall of said plurality of walls includes a pointed edge.

15. The drain apparatus as set forth in claim 14, wherein each of said pointed edges defines an arrow in cross section.

16. The drain apparatus as set forth in claim 1, wherein said attachment means comprises circumscribing threads disposed about said bulkhead fitting and including a threaded collar for mating with said circumscribing threads to secure said bulkhead fitting to a wall of the pool, spa or bath.

17. The drain apparatus as set forth in claim 16, including means for securing said plate to said bulkhead fitting.

18. The drain apparatus as set forth in claim 17, including further means for securing said cover to said plate.

19. The drain apparatus as set forth in claim 1, wherein the pool, spa or bath includes a liner of sheet material having an aperture corresponding with said central outlet of said bulkhead fitting and including means for engaging the liner intermediate said bulkhead fitting and said plate.

20. The drain apparatus as set forth in claim 19, including at least one gasket for creating a water tight seal with the liner.

21. A drain apparatus useable in a swimming pool, a spa or a whirlpool bath of cementitious material and mountable in a wall or bottom thereof for preventing entanglement of hair or body parts, said drain apparatus comprising in combination:

a) a ring fixedly lodged in the wall or bottom;

b) a plate secured to said ring for lodgement adjacent a surface of the pool, spa or bath and defining a central aperture adapted for fluid communication with a suction line;

c) a cover secured to said plate, said cover including:

1) a central impervious member;

2) a plurality of first orifices extending radially from said member;

3) a plurality of walls extending downwardly to said plate for defining a plurality of generally radially oriented passageways coincident with said first orifices;

4) an outlet orifice generally coincident with the radially interior end of each of said passageways and in fluid communication with said first orifices;

5) a plurality of second orifices located radially outwardly of said first orifices; and 6) a peripheral wall segregating said first orifices from said second orifices and defining a common peripheral passageway in fluid communication with each of said second orifices, said peripheral wall being spaced from said plate to provide fluid communication between said peripheral passageway and said radially oriented passageways.

22. A drain apparatus for conveying water from a pool, a spa or a whirlpool bath to a suction line in operative engagement with a suction pump, said drain apparatus comprising in combination:

a) a cover having a central impervious surface;

b) a plurality of passageways for conveying water from first orifices located in said cover outwardly of said central surface;

c) a bulkhead fitting having a central passageway in fluid communication with the suction line;

d) an outlet orifice associated with each of said passageways for conveying water to said central passageway;

e) a plurality of second orifices disposed adjacent said first orifices and segregated by a wall extending from in between said first and second orifices;

f) a peripheral passageway in fluid communication with each of said second orifices and in fluid communication with said passageways to provide a flow of water to said central passageway in said bulkhead fitting.

23. The drain apparatus as set forth in claim 22, wherein said passageways are serpentine in plan form.

24. The drain apparatus as set forth in claim 22, wherein each of said passageways is laterally defined by pairs of walls extending from a respective one of said first orifices.

25. The drain apparatus as set forth in claim 24, wherein a wall of each pair of walls is common to two adjacent passageways.

26. The drain apparatus as set forth in claim 25, wherein a wall of each pair of walls includes a cap of greater width than the thickness of the corresponding wall.

27. The drain apparatus as set forth in claim 26, wherein each of said caps tapers and wherein each of said walls is of constant thickness.

28. The drain apparatus as set forth in claim 26, including a ridge extending upwardly from each of said caps, each of said ridges being of a thickness less than the width of the respective one of said caps.

29. The drain apparatus as set forth in claim 28, wherein each of said ridges includes a rounded upper edge.

30. The drain apparatus as set forth in claim 26, wherein each of said caps includes opposed longitudinal edges and wherein each of said longitudinal edges is sharp edged.

31. The drain apparatus as set forth in claim 24, including a plate disposed beneath said cover for defining the bottom surfaces of said passageways.

32. The drain apparatus as set forth in claim 31, wherein said plate includes a plurality of depressions, each of said depressions being adapted to receive the bottom edge of one of said walls.

33. The drain apparatus as set forth in claim 22, wherein each of said passageways has a reducing dimension in a first plane from said first orifice to said outlet orifice and an increasing dimension in a second plane orthogonal to said first plane from said first orifice to said outlet orifice.

34. The drain apparatus as set forth in claim 22, including a collar threadedly engageable with said bulkhead fitting for securing said bulkhead fitting with a wall or bottom of the pool, spa or bath.

35. The drain apparatus as set forth in claim 34, including first attachment means for securing said cover to said plate and second attachment means for securing said plate to said bulkhead fitting.

36. A method for conveying water from a pool, spa or whirlpool bath to a suction line in operative engagement with a suction pump, said method comprising the steps of:

a) conveying water from first orifices located in a cover;

b) directing the water through a plurality of passageways to a central passageway in a bulkhead fitting in fluid communication with the suction line;

c) introducing a flow of water into the plurality of passageways through second orifices located adjacent the first orifices;

d) interconnecting the flows of water through the second orifices with a peripheral passageway in fluid communication with the plurality of passageways.

37. A method for conveying water as set forth in claim 36, including the steps of securing the bulkhead fitting to a wall or bottom of the pool, spa or bath with a collar adapted for threaded engagement with the bulkhead fitting.

38. A method for conveying water as set forth in claim 36, including the step of securing the bulkhead fitting to a liner of a pool, a spa or a bath with a plate attachable to the bulkhead fitting.

39. A method for conveying water as set forth in claim 36, including the step of reducing the flow rate of water through the passageways by expanding the cross sectional area of the passageways downstream.

40. A method for conveying water as set forth in claim 36, including the step of reducing the likelihood of covering the first orifices with ridges on opposed sides of the first orifices and extending away from the first orifices.

41. A method for conveying water from a pool, spa or whirlpool bath to a suction line in operative engagement with a suction pump, said method comprising the steps of:

a) conveying water from first orifice located in a cover;

b) directing the water through a plurality of passageways to a central aperture in a plate in fluid communication with the suction line;

c) introducing a flow of water into the plurality of passageways through second orifices located adjacent the first orifices; and d) interconnecting the flows of water through the second orifices with a peripheral passageway in fluid communication with the plurality of passageways.

42. A method for conveying water from a pool as set forth in claim 41, including the step of securing a ring generally coincident with the inlet to the suction line with settable material defining the pool, spa or bath during construction and the step of attaching the plate to the ring.

* * * * *